US007878780B2

(12) United States Patent
Bush et al.

(10) Patent No.: US 7,878,780 B2
(45) Date of Patent: Feb. 1, 2011

(54) SCROLL COMPRESSOR SUCTION FLOW PATH AND BEARING ARRANGEMENT FEATURES

(75) Inventors: James W. Bush, Skaneateles, NY (US); Wayne P. Beagle, Chittenango, NY (US)

(73) Assignee: Bitzer Kuhlmaschinenbau GmbH (DE)

( * ) Notice: Subject to any disclaimer, the term of this patent is extended or adjusted under 35 U.S.C. 154(b) by 480 days.

(21) Appl. No.: 12/015,592

(22) Filed: Jan. 17, 2008

(65) Prior Publication Data

US 2009/0185928 A1 Jul. 23, 2009

(51) Int. Cl.
*F04C 18/02* (2006.01)
*F04C 2/02* (2006.01)
*F04C 29/04* (2006.01)

(52) U.S. Cl. ..... 418/86; 418/55.1

(58) Field of Classification Search ..... 418/55.1, 418/55.2, 55.3, 55.6, 86
See application file for complete search history.

(56) References Cited

U.S. PATENT DOCUMENTS

| | | | | |
|---|---|---|---|---|
| 4,655,696 | A | 4/1987 | Utter | |
| 4,696,630 | A | 9/1987 | Sakata et al. | |
| 4,927,339 | A | 5/1990 | Riffe et al. | |
| 5,090,878 | A | 2/1992 | Haller | |
| 5,320,506 | A | 6/1994 | Fogt | |
| 5,427,511 | A | 6/1995 | Caillat et al. | |
| 5,582,312 | A | 12/1996 | Niles et al. | |
| 5,772,411 | A * | 6/1998 | Crum et al. | 418/55.1 |
| 6,227,830 | B1 | 5/2001 | Fields et al. | |
| 6,398,530 | B1 | 6/2002 | Hasemann | |
| 6,439,867 | B1 | 8/2002 | Clendenin | |
| 6,488,489 | B2 | 12/2002 | Williams et al. | |
| 6,682,327 | B2 | 1/2004 | Milliff et al. | |
| 6,761,541 | B1 | 7/2004 | Clendenin | |
| 6,814,551 | B2 | 11/2004 | Kammhoff et al. | |
| 6,960,070 | B2 | 11/2005 | Kammhoff et al. | |
| 7,018,184 | B2 * | 3/2006 | Skinner et al. | 418/55.1 |
| 7,112,046 | B2 | 9/2006 | Kammhoff et al. | |
| 7,708,536 | B2 * | 5/2010 | Ginies et al. | 418/55.6 |
| 2003/0031570 | A1 | 2/2003 | Kammhoff et al. | |
| 2003/0063986 | A1 | 4/2003 | Ginies et al. | |
| 2004/0170509 | A1 * | 9/2004 | Wehrenberg et al. | 417/371 |
| 2007/0003424 | A1 * | 1/2007 | Benco et al. | 418/55.3 |
| 2009/0185921 | A1 | 7/2009 | Beagle et al. | |
| 2009/0185926 | A1 | 7/2009 | Bush | |

(Continued)

FOREIGN PATENT DOCUMENTS

| | | |
|---|---|---|
| JP | 63-192985 A | 8/1988 |

(Continued)

*Primary Examiner*—Thomas E Denion
*Assistant Examiner*—Mary A Davis
(74) *Attorney, Agent, or Firm*—Reinhart Boerner Van Deuren P.C.

(57) ABSTRACT

A scroll compressor includes an oil separation region generally formed between the motor housing and upper bearing member. A long labyrinth channel is provided with the suction refrigerant gas flow path being redirected to facilitate coalescing of oil mist droplets out of the gas stream. An integral deflector plate can be provided on the upper bearing member to interrupt flow and facilitate coalescing of oil. Additionally, offset arrangements between motor housing outlet ports and through ports through the bearing member are provided to facilitate redirection of the refrigerant flow that can further achieve oil separation.

22 Claims, 6 Drawing Sheets

U.S. PATENT DOCUMENTS

| | | | |
|---|---|---|---|
| 2009/0185927 | A1 | 7/2009 | Duppert et al. |
| 2009/0185929 | A1 | 7/2009 | Duppert et al. |
| 2009/0185930 | A1 | 7/2009 | Duppert et al. |
| 2009/0185931 | A1 | 7/2009 | Beagle et al. |
| 2009/0185932 | A1 | 7/2009 | Beagle et al. |
| 2009/0185933 | A1 | 7/2009 | Bush et al. |
| 2009/0185934 | A1 | 7/2009 | Bush |

FOREIGN PATENT DOCUMENTS

| | | | |
|---|---|---|---|
| JP | 7-253091 | A | 10/1995 |
| JP | 7-332265 | A | 12/1995 |
| JP | 2003-3974 | A | 1/2003 |
| JP | 2003-293955 | A | 10/2003 |

* cited by examiner

SCROLL COMPRESSOR SUCTION FLOW PATH AND BEARING ARRANGEMENT FEATURES

FIELD OF THE INVENTION

The present invention relates to scroll compressors for compressing refrigerant and more particularly relates to the suction flow path for refrigerant and/or other such fluids within a scroll compressor; arrangements between motor housings and bearing members; and/or the coalescing of oil mist within such configurations.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 6,960,070 to Kammhoff et al.; and U.S. Pat. No. 7,112,046 to Kammhoff et al., all of which are assigned to a Bitzer entity closely related to the present assignee. As the present disclosure pertains to improvements that can be implemented in these or other scroll compressor designs, the entire disclosures of U.S. Pat. Nos. 6,398,530; 7,112,046; 6,814,551; and 6,960,070 are hereby incorporated by reference in their entireties.

As is exemplified by these patents, scroll compressors conventionally include an outer housing having a scroll compressor contained therein. A scroll compressor includes first and second scroll compressor members. A first compressor member is typically arranged stationary and fixed in the outer housing. A second scroll compressor member is moveable relative to the first scroll compressor member in order to compress refrigerant between respective scroll ribs which rise above the respective bases and engage in one another. Conventionally the moveable scroll compressor member is driven about an orbital path about a central axis for the purposes of compressing refrigerant. An appropriate drive unit, typically an electric motor, is provided usually within the same housing to drive the movable scroll member.

One feature known in the art is to attempt to provide for oil separation means in which lubricating oil droplets in the gaseous refrigerant is separated out of a refrigerant flow stream along the flow path through the housing. For example, the '046 patent to Kammhoff et al. utilizes deflecting units that are angularly aligned relative to the central axis with multiple outlet ports that are provided as punched holes in the cylindrical motor housing. Oil droplets which are entrained by refrigerant can be consequently deposited by virtue of being redirected by the deflector units, which are mounted to the inside of the outer housing shell.

The present invention pertains to improvements in the state of the art as it relates to these and other features.

BRIEF SUMMARY OF THE INVENTION

One inventive aspect is directed toward integrally providing a deflector wall in a bearing member (e.g. such as the upper bearing member according to an embodiment). According to this aspect, a scroll compressor can comprise an outer housing having an inlet port and an outlet port. Scroll compressor bodies in the outer housing have respective bases and respective scroll ribs that project from the respective bases and which mutually engage. A motor provides a rotational output on a drive shaft that operatively drives one of the scroll compressor bodies to facilitate relative movement for the compression of fluid. A motor housing generally surrounds the motor. A flow path for fluid runs through the outer housing from the inlet port to the outlet port, with a portion of the flow path running through the motor housing. At least one motor outlet is adapted to communicate fluid inside the motor housing to outside of the motor housing. A bearing member has a central hub rotatably supporting the drive shaft and body portion extending radially outward therefrom. A deflector wall projects from the body portion in a direction generally away from the compressor bodies. The deflector wall is arranged in angular alignment with the at least one motor outlet relative to the central axis so as to facilitate redirection and/or interruption of fluid flow.

Another inventive aspect is directed toward forming motor housing outlets between the motor housing and a bearing member by virtue of the configuration of the bearing member. According to this aspect a scroll compressor can comprise an outer housing having an inlet port and an outlet port. Scroll compressor bodies in the outer housing have respective bases and respective scroll ribs that project from the respective bases and which mutually engage. A motor provides a rotational output on a drive shaft that operatively drives one of the scroll compressor bodies to facilitate relative movement for the compression of fluid. A motor housing generally surrounds the motor. A flow path for fluid runs through the outer housing from the inlet port to the outlet port, with a portion of the flow path running through the motor housing. At least one motor outlet is adapted to communicate fluid inside the motor housing to outside of the motor housing. A bearing member has a central hub rotatably supporting the drive shaft and body portion extending radially outward therefrom. The motor housing includes a generally cylindrical body having a continuous circular terminating edge that abuts the bearing member. A relief (e.g. such as a notch, recess, groove, slot channel, etc) formed into the bearing member provides for the at least one motor outlet between the motor housing and the bearing member.

Yet another inventive aspect pertains to interrupting means (e.g. a deflector wall, surface irregularity, or other interruption) integrally provided on the bearing member for interrupting fluid flow in a region of the motor outlet. According to this aspect a scroll compressor can comprise an outer housing having an inlet port and an outlet port. Scroll compressor bodies in the outer housing have respective bases and respective scroll ribs that project from the respective bases and which mutually engage. A motor provides a rotational output on a drive shaft that operatively drives one of the scroll compressor bodies to facilitate relative movement for the compression of fluid. A motor housing generally surrounds the motor. A flow path for fluid runs through the outer housing from the inlet port to the outlet port, with a portion of the flow path running through the motor housing. At least one motor outlet is adapted to communicate fluid inside the motor housing to outside of the motor housing. A bearing member rotatably supports the drive shaft and integrally provides the interrupting means.

Yet another inventive aspect pertains to angularly spacing motor housing outlet and bearing through ports. According to this aspect a scroll compressor can comprise an outer housing having an inlet port and an outlet port. Scroll compressor bodies in the outer housing have respective bases and respective scroll ribs that project from the respective bases and which mutually engage. A motor provides a rotational output on a drive shaft that operatively drives one of the scroll compressor bodies to facilitate relative movement for the compression of fluid. A motor housing generally surrounds the motor. A flow path for fluid runs through the outer housing from the inlet port to the outlet port, with a portion of the flow path running through the motor housing. At least one motor outlet is adapted to communicate fluid inside the motor housing to outside of the motor housing. A bearing member rotatably supports the drive shaft. At least one through port is provided along the flow path for communicating fluid from one axial side of the bearing member toward the other axial side. Each motor outlet is arranged at a different angular position about the central axis than each through port.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
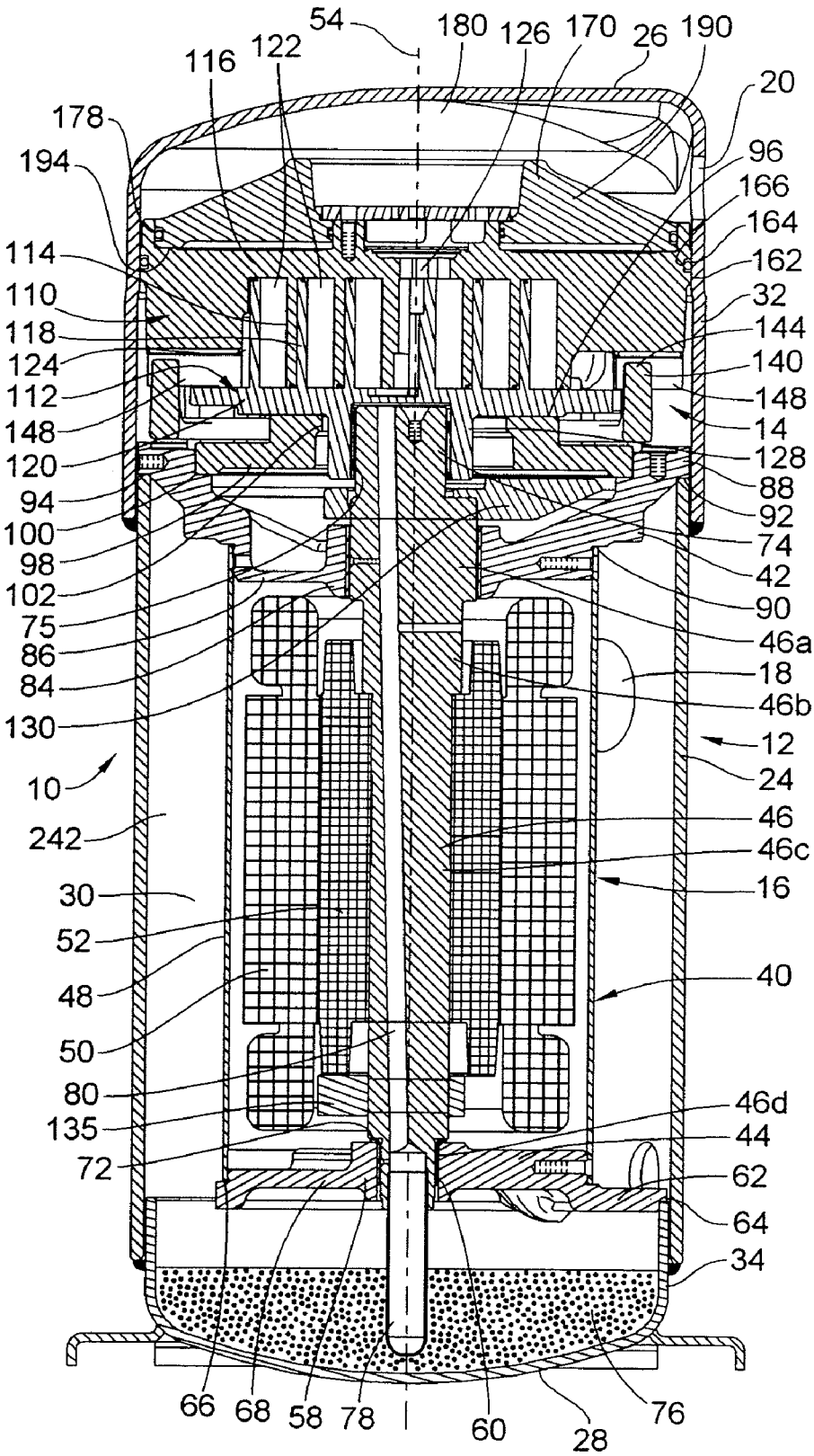
FIG. 1 is a cross section of a scroll compressor assembly in accordance with an embodiment of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

An embodiment of the present invention is illustrated in the figures as a scroll compressor assembly 10 generally including an outer housing 12 in which a scroll compressor 14 can be driven by a drive unit 16. The scroll compressor assembly may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The scroll compressor assembly 10 is operable through operation of the drive unit 16 to operate the scroll compressor 14 and thereby compress an appropriate refrigerant or other fluid that enters the refrigerant inlet port 18 and exits the refrigerant outlet port 20 in a compressed high pressure state.

The outer housing 12 may take many forms. In the preferred embodiment, the outer housing includes multiple shell sections and preferably three shell sections to include a central cylindrical housing section 24, a top end housing section 26 and a bottom end housing section 28. Preferably, the housing sections 24, 26, 28 are formed of appropriate sheet steel and welded together to make a permanent outer housing 12 enclosure. However, if disassembly of the housing is desired, other housing provisions can be made that can include metal castings or machined components.

The central housing section 24 is preferably cylindrical and telescopically interfits with the top and bottom end housing sections 26, 28. This forms an enclosed chamber 30 for housing the scroll compressor 14 and drive unit 16. Each of the top and bottom end housing sections 26, 28 are generally dome shaped and include respective cylindrical side wall regions 32, 34 to mate with the center section 24 and provide for closing off the top and bottom ends of the outer housing 12. As can be seen in FIG. 1, the top side wall region 32 telescopically overlaps the central housing section 24 and is exteriorly welded along a circular welded region to the top end of the central housing section 24. Similarly the bottom side wall region 34 of the bottom end housing section 28 telescopically interfits with the central housing section 24 (but is shown as being installed into the interior rather than the exterior of the central housing section 24) and is exteriorly welded by a circular weld region.

The drive unit 16 may preferably take the form of an electrical motor assembly 40, which is supported by upper and lower bearing members 42, 44. The motor assembly 40 operably rotates and drives a shaft 46. The electrical motor assembly 40 generally includes an outer annular motor housing 48, a stator 50 comprising electrical coils and a rotor 52 that is coupled to the drive shaft 46 for rotation together. Energizing the stator 50 is operative to rotatably drive the rotor 52 and thereby rotate the drive shaft 46 about a central axis 54.

Figure 4:
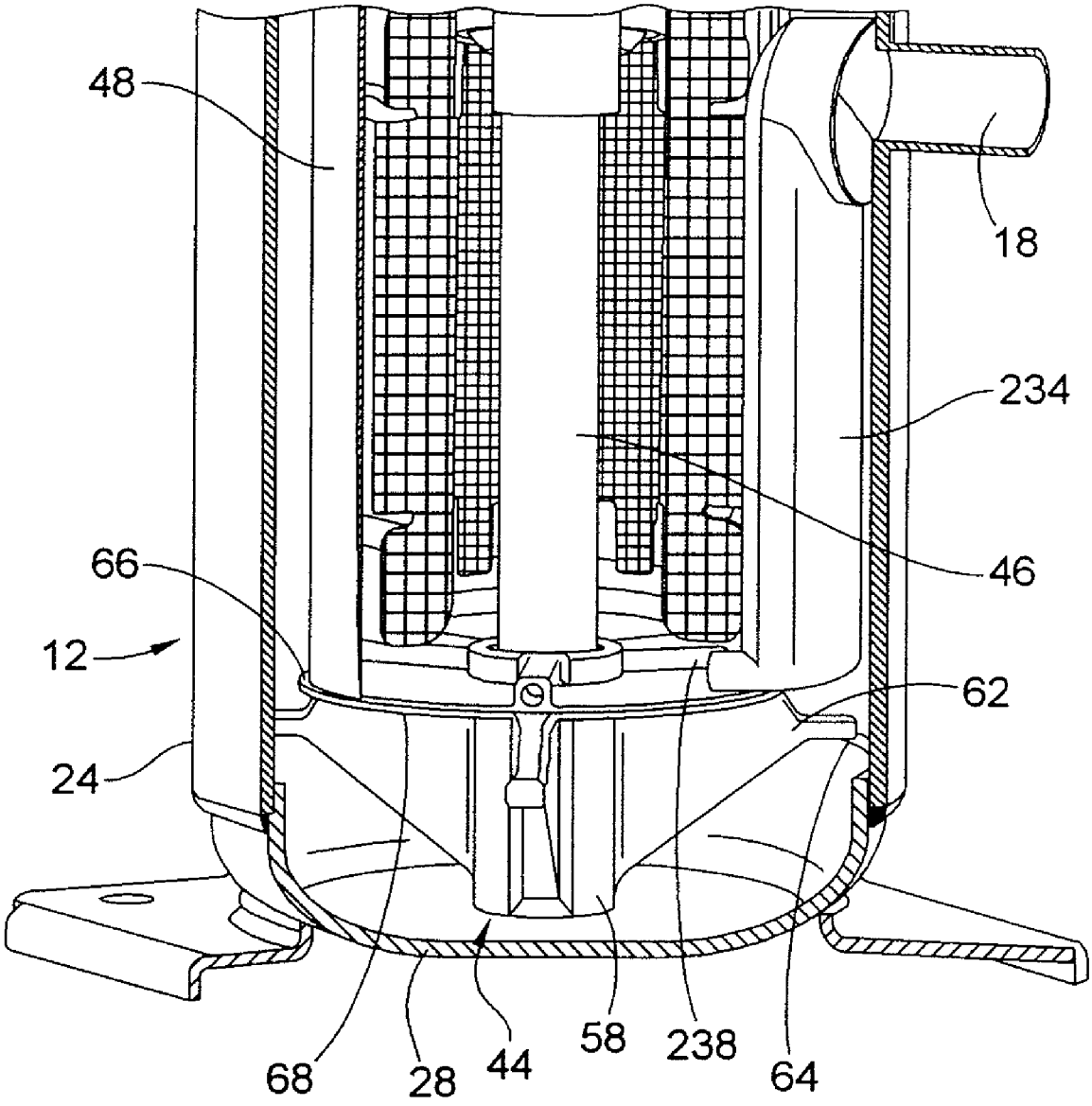
FIG. 4 is a partial cross section and cut-away view of a lower portion of the embodiment of FIG. 1.

With reference to FIGS. 1 and 4, the lower bearing member 44 includes a central generally cylindrical hub 58 that includes a central bushing and opening to provide a cylindrical bearing 60 to which the drive shaft 46 is journaled for rotational support. A plurality of arms 62 and typically at least three arms project radially outward from the bearing central hub 58 preferably at equally spaced angular intervals. These support arms 62 engage and are seated on a circular seating surface 64 provided by the terminating circular edge of the bottom side wall region 34 of the bottom outer housing section 28. As such, the bottom housing section 28 can serve to locate, support and seat the lower bearing member 44 and thereby serves as a base upon which the internal components of the scroll compressor assembly can be supported.

The lower bearing member 44 in turn supports the cylindrical motor housing 48 by virtue of a circular seat 66 formed on a plate-like ledge region 68 of the lower bearing member 44 that projects outward along the top of the central hub 58. The support arms 62 also preferably are closely toleranced relative to the inner diameter of the central housing section. The arms 62 may engage with the inner diameter surface of the central housing section 24 to centrally locate the lower bearing member 44 and thereby maintain position of the central axis 54. This can be by way of an interference and press-fit support arrangement between the lower bearing member 44 and the outer housing 12 (See e.g. FIG. 4). Alternatively according to a more preferred configuration, as shown in FIG. 1, the lower bearing engages with the lower housing section 28 which is in turn attached to center section 24. Likewise, the outer motor housing 48 may be supported with an interference and press-fit along the stepped seat 66 of the lower bearing member 44. As shown, screws may be used to securely fasten the motor housing to the lower bearing member 44.

The drive shaft 46 is formed with a plurality of progressively smaller diameter sections 46*a*-46*d* which are aligned concentric with the central axis 54. The smallest diameter section 46*d* is journaled for rotation within the lower bearing member 44 with the next smallest section 46*c* providing a step 72 for axial support of the drive shaft 46 upon the lower bearing member 44. The largest section 46*a* is journaled for rotation within the upper bearing member 42.

The drive shaft 46 further includes an offset eccentric drive section 74 that has a cylindrical drive surface 75 about an offset axis that is offset relative to the central axis 54. This offset drive section 74 is journaled within a cavity of the movable scroll member of the scroll compressor 14 to drive the movable member of the scroll compressor about an orbital path when the drive shaft 46 is spun about the central axis 54. To provide for lubrication of all of these bearing surfaces, the outer housing 12 provides an oil lubricant sump 76 at the bottom end in which suitable oil lubricant is provided. The drive shaft 46 has an oil lubricant pipe and impeller 78 that acts as an oil pump when the drive shaft is spun and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 includes various radial passages as shown to feed oil through centrifugal force to appropriate bearing surfaces and thereby lubricate sliding surfaces as may be desired.

The upper bearing member 42 includes a central bearing hub 84 into which the largest section 46*a* of the drive shaft 46 is journaled for rotation. Extending outward from the bearing hub 84 is a support web 86 that merges into an outer peripheral support rim 88. Provided along the support web 86 is an annular stepped seating surface 90 which may have an interference and press-fit with the top end of the cylindrical motor housing 48 to thereby provide for axial and radial location. The motor housing 48 may also be fastened with screws to the upper bearing member 42. The outer peripheral support rim 88 also may include an outer annular stepped seating surface 92 which may have an interference and press-fit with the outer housing 12. For example, the outer peripheral rim 88 can engage the seating surface 92 axially, that is it engages on a lateral plane perpendicular to axis 54 and not through a diameter. To provide for centering there is provided a diametric fit just below the surface 92 between the central housing section 24 and the support rim 88. Specifically, between the telescoped central and top-end housing sections 24, 26 is defined in internal circular step 94, which is located axially and radially with the outer annular step 92 of the upper bearing member 42.

The upper bearing member 42 also provides axial thrust support to the movable scroll member through a bearing support via an axial thrust surface 96. While this may be integrally provided by a single unitary component, it is shown as being provided by a separate collar member 98 that is interfit with the upper portion of the upper bearing member 42 along stepped annular interface 100. The collar member 98 defines a central opening 102 that is a size large enough to provide for receipt of the eccentric offset drive section 74 and allow for orbital eccentric movement thereof that is provided within a receiving portion of the movable scroll compressor member 112.

Turning in greater detail to the scroll compressor 14, the scroll compressor body is provided by first and second scroll compressor bodies which preferably include a stationary fixed scroll compressor body 110 and a movable scroll compressor body 112. The moveable scroll compressor body 112 is arranged for orbital movement relative to the fixed scroll compressor body 110 for the purpose of compressing refrigerant. The fixed scroll compressor body includes a first rib 114 projecting axially from a plate-like base 116 and is designed in the form of a spiral. Similarly, the second movable scroll compressor body 112 includes a second scroll rib 118 projecting axially from a plate-like base 120 and is in the design form of a similar spiral. The scroll ribs 114, 118 engage in one another and abut sealingly on the respective base surfaces 120, 116 of the respectively other compressor body 112, 110. As a result, multiple compression chambers 122 are formed between the scroll ribs 114, 118 and the bases 120, 116 of the compressor bodies 112, 110. Within the chambers 122, progressive compression of refrigerant takes place. Refrigerant flows with an initial low pressure via an intake area 124 surrounding the scroll ribs 114, 118 in the outer radial region (see e.g. FIGS. 2-3). Following the progressive compression in the chambers 122 (as the chambers progressively are defined radially inward), the refrigerant exits via a compression outlet 126 which is defined centrally within the base 116 of the fixed scroll compressor body 110. Refrigerant that has been compressed to a high pressure can exit the chambers 122 via the compression outlet 126 during operation of the scroll compressor.

The movable scroll compressor body 112 engages the eccentric offset drive section 74 of the drive shaft 46. More specifically, the receiving portion of the movable scroll compressor body 112 includes a cylindrical bushing drive hub 128 which slideably receives the eccentric offset drive section 74 with a slideable bearing surface provided therein. In detail, the eccentric offset drive section 74 engages the cylindrical drive hub 128 in order to move the moveable scroll compressor body 112 about an orbital path about the central axis 54 during rotation of the drive shaft 46 about the central axis 54. Considering that this offset relationship causes a weight imbalance relative to the central axis 54, the assembly preferably includes a counter weight 130 that is mounted at a fixed angular orientation to the drive shaft 46. The counter weight 130 acts to offset the weight imbalance caused by the eccentric offset drive section 74 and the movable scroll compressor body 112 that is driven about an orbital path (e.g. among other things, the scroll rib is not equally balanced). The counter weight 130 includes an attachment collar 132 and an offset weight region 134 (see counter weight shown best in FIG. 2) that provides for the counter weight effect and thereby balancing of the overall weight of the rotating components about the central axis 54 in cooperation with a lower counterweight 135 for balancing purposes. This provides for reduced vibration and noise of the overall assembly by internally balancing or cancelling out inertial forces.

Figure 2:
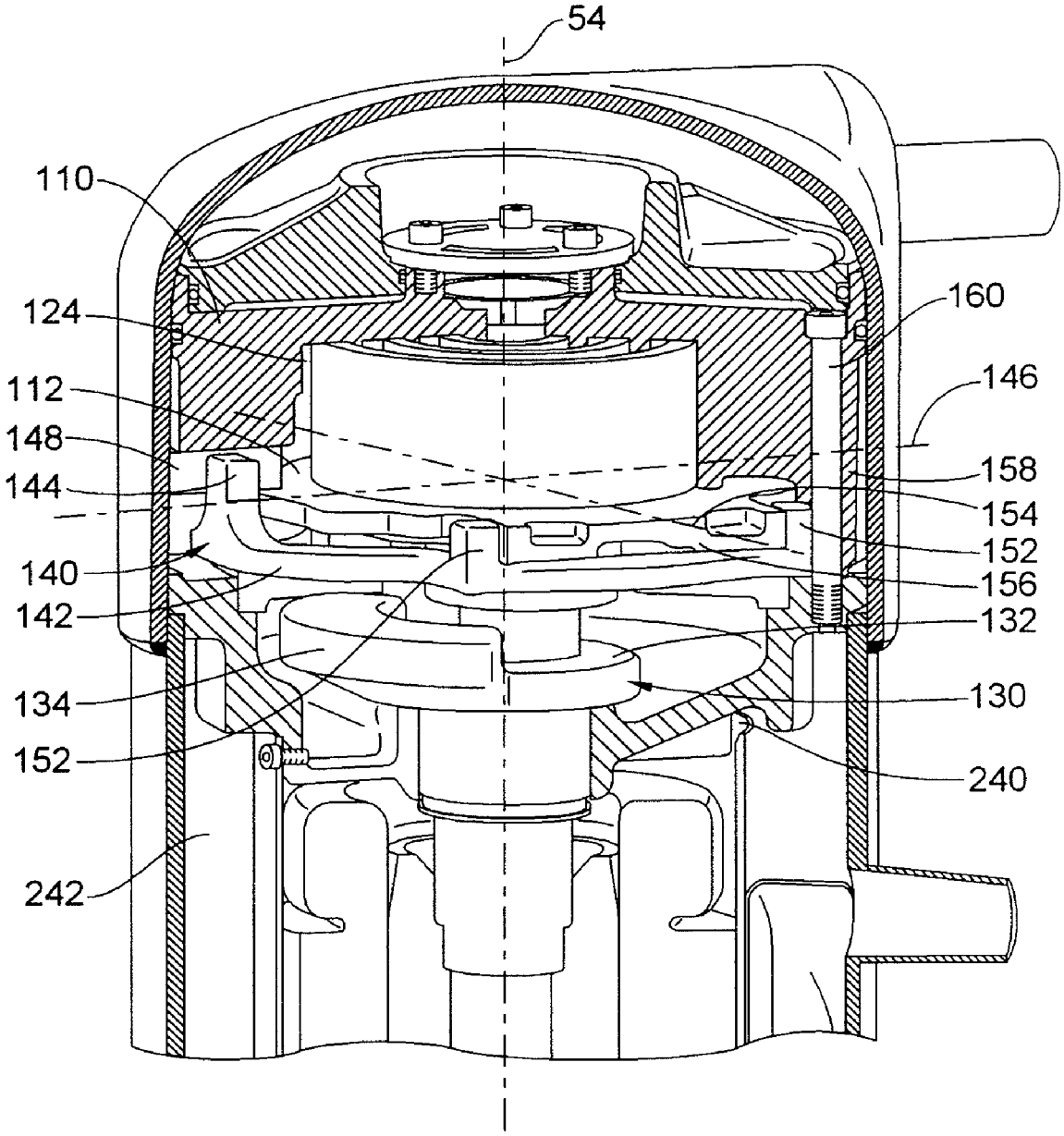
FIG. 2 is a partial cross section and cut-away view of an isometric drawing of an upper portion of the scroll compressor embodiment shown in FIG. 1.
Figure 3:
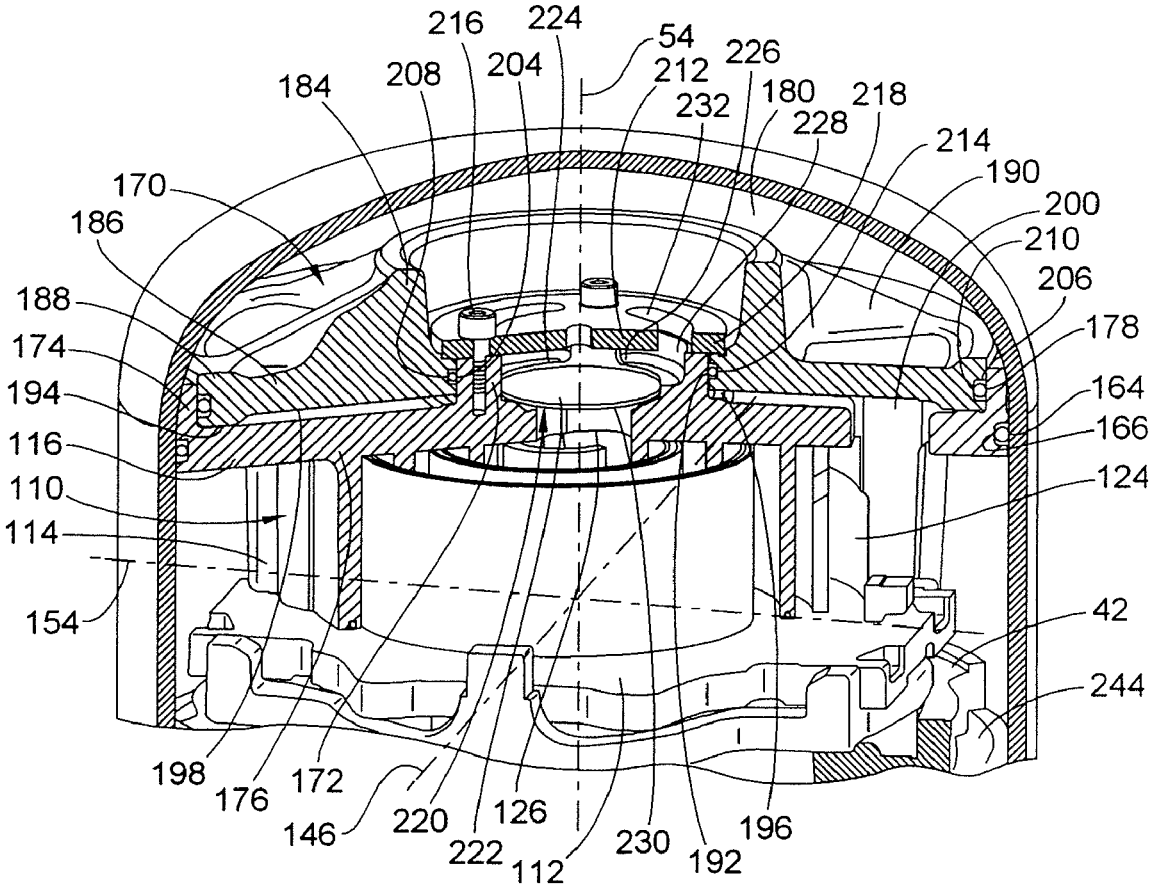
FIG. 3 is a similar view to FIG. 2 but enlarged and taken about a different angle and section in order to show other structural features.

With reference to FIGS. 1-3, and particularly FIG. 2, the guiding movement of the scroll compressor can be seen. To guide the orbital movement of the movable scroll compressor body 112 relative to the fixed scroll compressor body 110, an appropriate key coupling 140 may be provided. Keyed couplings are often referred to in the scroll compressor art as an "Oldham Coupling." In this embodiment, the key coupling 140 includes an outer ring body 142 and includes two first keys 144 that are linearly spaced along a first lateral axis 146 and that slide closely and linearly within two respective keyway tracks 148 that are linearly spaced and aligned along the first axis 146 as well. The key way tracks 148 are defined by the stationary fixed scroll compressor body 110 such that the linear movement of the key coupling 140 along the first lateral axis 146 is a linear movement relative to the outer housing 12 and perpendicular to the central axis 54. The keys can comprise slots, grooves or, as shown, projections which project from the ring body 142 of the key coupling 140. This control of movement over the first lateral axis 146 guides part of the overall orbital path of the moveable scroll compressor body 112.

Additionally, the key coupling includes four second keys 152 in which opposed pairs of the second keys 152 are linearly aligned substantially parallel relative to a second traverse lateral axis 154 that is perpendicular to the first lateral axis 146. There are two sets of the second keys 152 that act cooperatively to receive projecting sliding guide portions 156 that project from the base 120 on opposite sides of the movable scroll compressor body 112. The guide portions 156 linearly engage and are guided for linear movement along the second traverse lateral axis by virtue of sliding linear guiding movement of the guide portions 156 along sets of the second keys 152.

By virtue of the key coupling 140, the moveable scroll compressor body 112 has movement restrained relative to the fixed scroll compressor body 110 along the first lateral axis 146 and second traverse lateral axis 154. This results in the prevention of any relative rotation of the moveable scroll body as it allows only translational motion. More particularly, the fixed scroll compressor body 110 limits motion of the key coupling 140 to linear movement along the first lateral axis 146; and in turn, the key coupling 140 when moving along the first lateral axis 146 carries the moveable scroll 112 along the first lateral axis 146 therewith. Additionally, the movable scroll compressor body can independently move relative to the key coupling 140 along the second traverse lateral axis 154 by virtue of relative sliding movement afforded by the guide portions 156 which are received and slide between the second keys 152. By allowing for simultaneous movement in two mutually perpendicular axes 146, 154, the eccentric motion that is afforded by the eccentric offset drive section 74 of the drive shaft 46 upon the cylindrical drive hub 128 of the movable scroll compressor body 112 is translated into an orbital path movement of the movable scroll compressor body 112 relative to the fixed scroll compressor body 110.

Referring in greater detail to the fixed scroll compressor body 110, this body 110 is fixed to the upper bearing member 42 by an extension extending axially and vertically therebetween and around the outside of the moveable scroll compressor body 112. In the illustrated embodiment, the fixed scroll compressor body 110 includes a plurality of axially projecting legs 158 (see FIG. 2) projecting on the same side as the scroll rib from the base 116. These legs 158 engage and are seated against the top side of the upper bearing member 42. Preferably, bolts 160 (FIG. 2) are provided to fasten the fixed scroll compressor body 110 to the upper bearing member 42. The bolts 160 extend axially through the legs 158 of the fixed scroll compressor body and are fastened and screwed into corresponding threaded openings in the upper bearing member 42. For further support and fixation of the fixed scroll compressor body 110, the outer periphery of the fixed scroll compressor body includes a cylindrical surface 162 that is closely received against the inner cylindrical surface of the outer housing 10 and more particularly the top end housing section 26. A clearance gap between surface 162 and side wall 32 serves to permit assembly of upper housing 26 over the compressor assembly and subsequently to contain the o-ring seal 164. An O-ring seal 164 seals the region between the cylindrical locating surface 162 and the outer housing 112 to prevent a leak path from compressed high pressure fluid to the un-compressed section/sump region inside of the outer housing 12. The seal 164 can be retained in a radially outward facing annular groove 166.

With reference to FIGS. 1-3 and particularly FIG. 3, the upper side (e.g. the side opposite the scroll rib) of the fixed scroll 110 supports a floatable baffle member 170. To accommodate the same, the upper side of the fixed scroll compressor body 110 includes an annular and more specifically cylindrical inner hub region 172 and an outwardly spaced peripheral rim 174 which are connected by radially extending disc region 176 of the base 116. Between the hub 172 and the rim 174 is provided an annular piston-like chamber 178 into which the baffle member 170 is received. With this arrangement, the combination of the baffle member 170 and the fixed scroll compressor body 110 serve to separate a high pressure chamber 180 from lower pressure regions within the housing 10. While the baffle member 170 is shown as engaging and constrained radially within the outer peripheral rim 174 of the fixed scroll compressor body 110, the baffle member 170 could alternatively be cylindrically located against the inner surface of the outer housing 12 directly.

As shown in the embodiment, and with particular reference to FIG. 3, the baffle member 170 includes an inner hub region 184, a disc region 186 and an outer peripheral rim region 188. To provide strengthening, a plurality of radially extending ribs 190 extending along the top side of the disc region 186 between the hub region 184 and the peripheral rim region 188 may be integrally provided and are preferably equally angularly spaced relative to the central axis 54. The baffle member 170 in addition to tending to separate the high pressure chamber 180 from the remainder of the outer housing 12 also serves to transfer pressure loads generated by high pressure chamber 180 away from the inner region of the fixed scroll compressor body 110 and toward the outer peripheral region of the fixed scroll compressor body 110. At the outer peripheral region, pressure loads can be transferred to and carried more directly by the outer housing 12 and therefore avoid or at least minimize stressing components and substantially avoid deformation or deflection in working components such as the scroll bodies. Preferably, the baffle member 170 is floatable relative to the fixed scroll compressor body 110 along the inner peripheral region. This can be accomplished, for example, as shown in the illustrated embodiment by a sliding cylindrical interface 192 between mutually cylindrical sliding surfaces of the fixed scroll compressor body and the baffle member along the respective hub regions thereof. As compressed high pressure refrigerant in the high pressure chamber 180 acts upon the baffle member 170, substantially no load may be transferred along the inner region, other than as may be due to frictional engagement. Instead, an axial contact interface ring 194 is provided at the radial outer periphery where the respective rim regions are located for the fixed scroll compressor body 110 and the baffle member 170. Preferably, an annular axial gap 196 is provided between the innermost diameter of the baffle member 170 and the upper side of the fixed scroll compressor body 110. The annular axial gap 196 is defined between the radially innermost portion of the baffle member and the scroll member and is adapted to decrease in size in response to a pressure load caused by high pressure refrigerant compressed within the high pressure chamber 180. The gap 196 is allowed to expand to its relaxed size upon relief of the pressure and load.

To facilitate load transfer most effectively, an annular intermediate or lower pressure chamber 198 is defined between the baffle member 170 and the fixed scroll compressor body 110. This intermediate or lower pressure chamber can be subject to either the lower sump pressure as shown, or can be subject to an intermediate pressure (e.g. through a fluid communication passage defined through the fixed scroll compressor body to connect one of the individual compression chambers 122 to the chamber 198). Load carrying characteristics can therefore be configured based on the lower or intermediate pressure that is selected for best stress/deflection management. In either event, the pressure contained in the intermediate or low pressure chamber 198 during operation is substantially less than the high pressure chamber 180 thereby causing a pressure differential and load to develop across the baffle member 170.

To prevent leakage and to better facilitate load transfer, inner and outer seals 204, 206 may be provided, both of which may be resilient, elastomeric O-ring seal members. The inner seal 204 is preferably a radial seal and disposed in a radially inwardly facing inner groove 208 defined along the inner diameter of the baffle member 170. Similarly the outer seal 206 can be disposed in a radially outwardly facing outer groove 210 defined along the outer diameter of the baffle member 170 in the peripheral rim region 188. While a radial seal is shown at the outer region, alternatively or in addition an axial seal may be provided along the axial contact interface ring 194.

While the baffle member 170 could be a stamped steel component, preferably and as illustrated, the baffle member 170 comprises a cast and/or machined member (and may be aluminum) to provide for the expanded ability to have several structural features as discussed above. By virtue of making the baffle member in this manner, heavy stamping of such baffles can be avoided.

Additionally, the baffle member 170 can be retained to the fixed scroll compressor body 110. Specifically, as can be seen in the figures, a radially inward projecting annular flange 214 of the inner hub region 184 of the baffle member 170 is trapped axially between the stop plate 212 and the fixed scroll compressor body 110. The stop plate 212 is mounted with bolts 216 to a fixed scroll compressor body 210. The stop plate 212 includes an outer ledge 218 that projects radially over the inner hub 172 of the fixed scroll compressor body 110. The stop plate ledge 218 serves as a stop and retainer for the baffle member 170. In this manner, the stop plate 212 serves to retain the baffle member 170 to the fixed scroll compressor body 110 such that the baffle member 170 is carried thereby.

As shown, the stop plate 212 can be part of a check valve 220. The check valve includes a moveable valve plate element 222 contained within a chamber defined in the outlet area of the fixed scroll compressor body within the inner hub 172. The stop plate 212 thus closes off a check valve chamber 224 in which the moveable valve plate element 222 is located. Within the check valve chamber there is provided a cylindrical guide wall surface 226 that guides the movement of the check valve 220 along the central axis 54. Recesses 228 are provided in the upper section of the guide wall 226 to allow for compressed refrigerant to pass through the check valve when the moveable valve plate element 222 is lifted off of the valve seat 230. Openings 232 are provided in the stop plate 212 to facilitate passage of compressed gas from the scroll compressor into the high pressure chamber 180. The check valve is operable to allow for one way directional flow such that when the scroll compressor is operating, compressed refrigerant is allowed to leave the scroll compressor bodies through the compression outlet 126 by virtue of the valve plate element 222 being driven off of its valve seat 230. However, once the drive unit shuts down and the scroll compressor is no longer operating, high pressure contained within the high pressure chamber 180 forces the movable valve plate element 222 back upon the valve seat 230. This closes off check valve 220 and thereby prevents backflow of compressed refrigerant back through the scroll compressor.

During operation, the scroll compressor assembly 10 is operable to receive low pressure refrigerant at the housing inlet port 18 and compress the refrigerant for delivery to the high pressure chamber 180 where it can be output through the housing outlet port 20. As is shown, in FIG. 4, an internal conduit 234 can be connected internally of the housing 12 to guide the lower pressure refrigerant from the inlet port 18 into the motor housing via a motor housing inlet 238. This allows the low pressure refrigerant to flow across the motor and thereby cool and carry heat away from the motor which can be caused by operation of the motor. Low pressure refrigerant can then pass longitudinally through the motor housing and around through void spaces therein toward the top end where it can exit through a plurality of motor housing outlets 240 (see FIG. 2) that are equally angularly spaced about the central axis 54. The motor housing outlets 240 may be defined either in the motor housing 48, the upper bearing member 42 or by a combination of the motor housing and upper bearing member (e.g. by gaps formed therebetween as shown in FIG. 2). Upon exiting the motor housing outlet 240, the low pressure refrigerant enters an annular chamber 242 formed between the motor housing and the outer housing. From there, the low pressure refrigerant can pass through the upper bearing member through a pair of opposed outer peripheral through ports 244 that are defined by recesses on opposed sides of the upper bearing member 42 to create gaps between the bearing member 42 and housing 12 as shown in FIG. 3 (or alternatively holes in bearing member 42). The through ports 244 may be angularly spaced relative to the motor housing outlets 240. Upon passing through the upper bearing member 42, the low pressure refrigerant finally enters the intake area 124 of the scroll compressor bodies 110, 112. From the intake area 124, the lower pressure refrigerant finally enters the scroll ribs 114, 118 on opposite sides (one intake on each side of the fixed scroll compressor body) and is progressively compressed through chambers 122 to where it reaches it maximum compressed state at the compression outlet 126 where it subsequently passes through the check valve 220 and into the high pressure chamber 180. From there, high pressure compressed refrigerant may then pass from the scroll compressor assembly 10 through the refrigerant housing outlet port 20.

Figure 5:
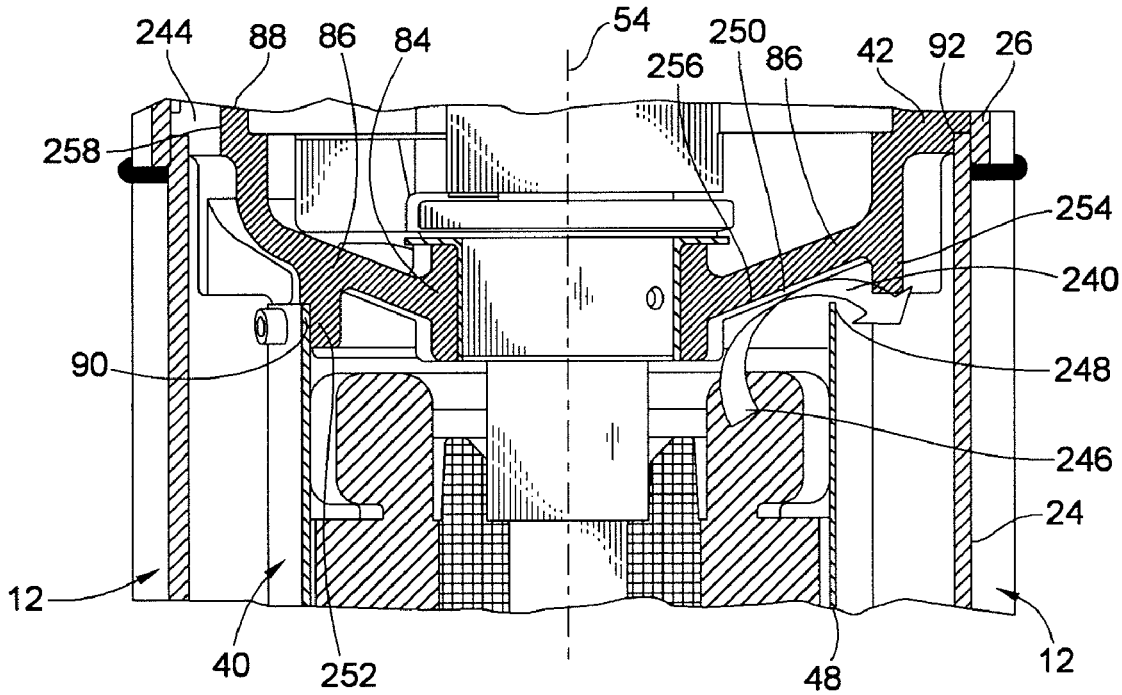
FIG. 5 is a partial isometric and partial cut-away view (taken at less than 180 degrees) of an intermediate portion of a scroll compressor assembly to better show the upper bearing and motor housing interface as well as to illustrate the flow path arrangement at this region.
Figure 6:
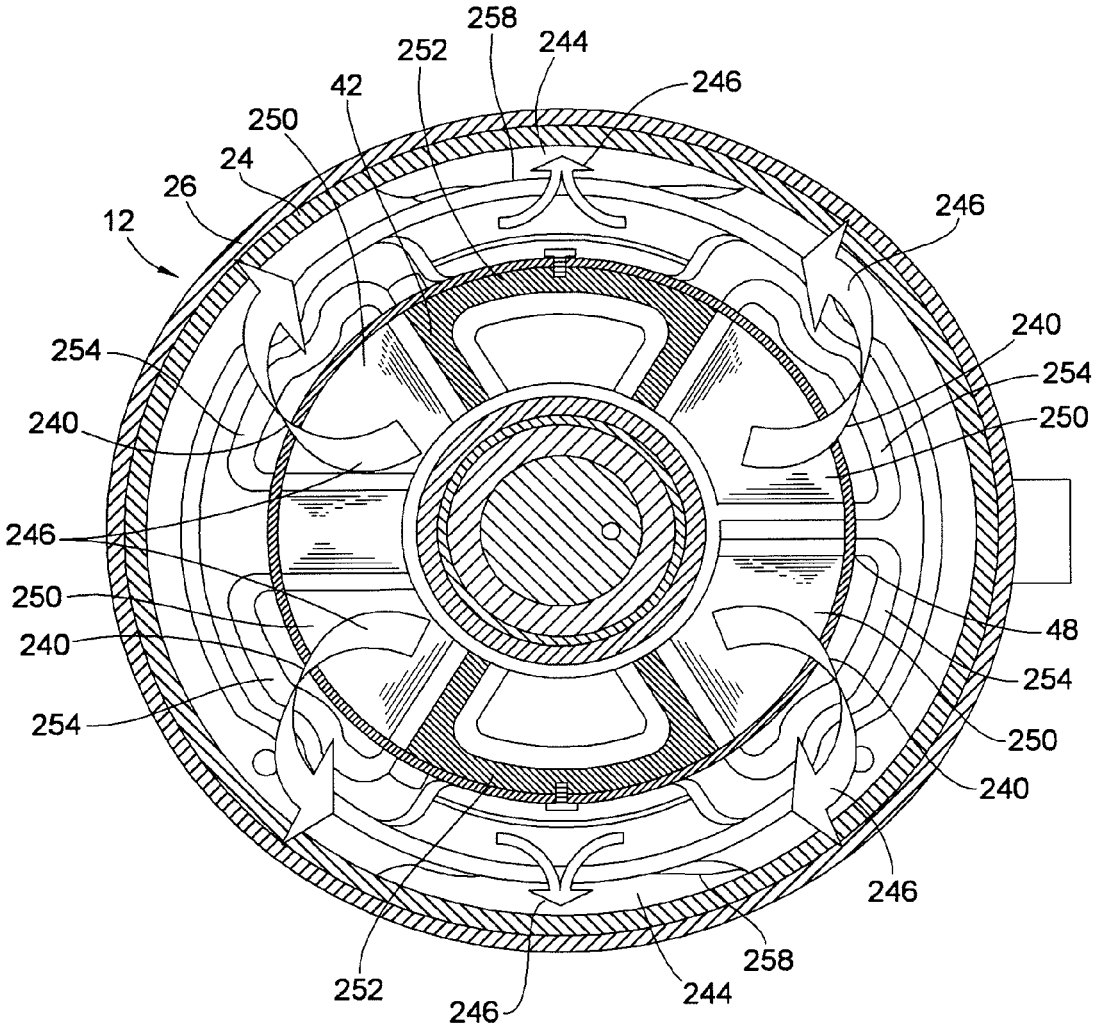
FIG. 6 is a cross section taken at a plane perpendicular through the central axis of the scroll compressor assembly to similarly illustrate flow path features in conjunction with FIG. 5.

Turning to FIGS. 5 and 6, the bearing member/motor housing interface and flow path configuration between the motor assembly 40, the upper bearing member 42, and the outer housing 12 is illustrated in greater detail. To assist in facilitating and understanding, the fluid flow path through the scroll compressor at this region has been illustrated with flow path arrows 246 (motor housing outlets 240 and through ports 244 are also disposed along the flow path indicated at 246).

As is illustrated, at least one and typically symmetrically spaced two or four motor housing outlets 240 are provided. As illustrated in FIG. 5, the motor housing outlets 240 can be formed between a terminating top edge 248 of the motor housing 48 and the upper bearing member 42. The terminating top edge 248 is circular and lies in a plane perpendicular to the central axis 54. Part of this terminating edge 248 is axially seated along the annular stepped seat region 90, whereas part of the edge 248 is separated from the upper bearing member 42 by virtue of reliefs that can be formed by recessed regions 250 in the upper bearing member 42. These regions 250 are free of cylindrical mounting wall sections 252 (the cylindrical mounting walls sections provide the stepped interface region at 90). As such, the motor outlets 240 are generally provided by gaps between the motor housing 48 and the upper bearing member 42. This can reduce or eliminate the need to punch out or cut out slots or holes in the motor housing 48. In a preferred embodiment, for example, the motor housing may be a hollow, open ended, cylindrical thin walled body which is free of flow openings formed therethrough.

Another feature is the provision for an integral deflector wall 254 that is provided with the upper bearing member 42. Preferably, the deflector wall 254 is not only integral but also further unitarily formed with the support web 86 region of the upper bearing member 42. As shown, the deflector wall 254 may take the form of a generally cylindrical wall section, and in the case of multiple outlets, multiple cylindrical wall sections as illustrated in FIGS. 5 and 6. Each deflector wall 254 projects along the bottom from the body portion of the upper bearing member 42. For example, the upper bearing member can include an inclined and more specifically a conical surface section 256 along the bottom of the upper bearing member 42. Each deflector wall 254 is arranged in angular alignment with one of the motor outlets 240 so as to act to interrupt fluid flow in this region. Specifically, the continuously upwardly inclined surface is interrupted by the deflector wall and this interruption provides means for interrupting fluid flow in the region around the motor outlet. As shown, the deflector wall 254 extends in a direction generally away from the scroll compressor bodies and towards the bottom end of the scroll compressor so as to redirect the fluid downward. Also, preferably the deflector wall 254 extends over the outside of the motor housing outlets 240. This provides a labyrinth channel that coalesces oil mist droplets on surfaces as fluid flows therethrough. Specifically, heavier oil mist droplets tend to separate out as such mist droplets have momentum within the fluid stream that tends to carry the particles along a prior existing path when the fluid stream is redirected. This oil mist particle momentum causes oil mist particles to tend to impinge upon a surface when the fluid stream is redirected thereby causing oil mist to coalesce out of a gaseous fluid stream.

As illustrated, the deflector wall 254 can be provided by the upper bearing member 42 and there may be no need to similarly provide deflector walls welded or otherwise directly connected to the interior of the outer housing 12. Additionally, by forming the recess or relief area into the upper bearing member, the flow path can extend all the way through the motor housing rather than exiting along the side of the motor housing through punched out ports as is the case in the aforementioned '046 patent. Punching out ports is therefore not necessary and can be eliminated if desired.

As illustrated, the motor housing generally can be spaced from and free of contact with the outer housing which thereby forms an annular chamber 30 therebetween. This annular chamber 30 receives refrigerant which is passed through the motor assembly 40 as illustrated by the flow path arrows 246. Continuing with the redirection and labyrinth channel flow path arrangement which forces the fluid to redirect several times in this region for the purpose of coalescing oil, yet another feature that can be provided additionally or in the alternative relates to internal porting arrangements. As shown best in FIGS. 5 and 6, upper bearing through ports 244 are provided in angular spaced relation relative to motor outlets 240. Specifically, each motor outlet 240 is arranged at a different angular position about the central axis than each through port 244 which can be seen for all of these ports in FIG. 6. Whereas each motor outlet may be jointly defined by the motor housing and the upper bearing member, similarly, the through ports 244 may be defined jointly between the outer housing 12 and the upper bearing member 42. For example, through ports 244, can be formed by virtue of flattened regions 258 formed into the upper bearing member that are spaced 180 degrees apart on either side of the bearing member. When the upper bearing member is installed within the outer cylindrical housing, the flattened regions 258 form gaps between the upper bearing member 42 and the outer housing 12 which are also spaced 180 degrees apart. As shown in FIG. 6, the motor outlets can be on opposite sides of the motor housings in regions generally between the through ports 244 for fluid balancing and symmetrical relationship reasons. As is illustrated best in FIG. 6, the arrangement of different angular positions between motor outlets and the through ports causes the oil again to redirect flow along a longer path both of which have the effect of tending to separate and coalesce oil mist droplets from the suction gas refrigerant stream. Thus, several different oil separation aspects provided with the foregoing embodiments and may be used in embodiments of the present invention.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A scroll compressor for compressing fluid, comprising, an outer housing having an inlet port and an outlet port;

scroll compressor bodies in the outer housing, the scroll compressor bodies having respective bases and respective scroll ribs that project from the respective bases and which mutually engage;

a motor providing a rotational output on a drive shaft, the drive shaft operatively driving one of the scroll compressor bodies to facilitate relative movement for the compression of fluid;

a motor housing in surrounding relation of the motor;

a flow path for fluid, the flow path running through the outer housing from the inlet port to the outlet port, a portion of the flow path running through the motor housing;

at least one motor outlet adapted to communicate fluid inside the motor housing to outside of the motor housing; and a bearing member having a central hub rotatably supporting the drive shaft and body portion extending radially outward therefrom, and a deflector wall projecting from the body portion in a direction away from the compressor bodies, the deflector wall arranged in angular alignment with the at least one motor outlet relative to the central axis;

wherein the deflector wall extends over an outside periphery of the motor housing for redirecting fluid after fluid has exited through the motor outlet.

2. The scroll compressor of claim 1, further comprising:

at least one through port along the flow path communicating fluid from one axial side of the bearing member toward the other axial side; and wherein the each motor outlet is arranged at a different angular position about the central axis than each through port.

3. The scroll compressor of claim 2, wherein the body portion defines an inclined surface in angular alignment relative to the central axis with the at least one motor outlet and the deflector wall.

4. The scroll compressor of claim 3, wherein the inclined surface cants toward the scroll compressor bodies as the inclined surface extends radially outward.

5. The scroll compressor of claim 4, wherein the inclined surface comprises a substantially conical surface section.

6. The scroll compressor of claim 1, wherein the motor housing including a substantially cylindrical body having a continuous circular terminating edge, the terminating edge abutting the bearing member, wherein a relief formed into the bearing member provides for the at least one motor outlet between the motor housing and the bearing member.

7. The scroll compressor of claim 1, wherein the motor housing is spaced from and free of contact with the outer housing.

8. The scroll compressor of claim 1, wherein the deflector wall is a substantially cylindrical wall section.

9. A scroll compressor for compressing fluid, comprising, an outer housing having an inlet port and an outlet port;

scroll compressor bodies in the outer housing, the scroll compressor bodies having respective bases and respective scroll ribs that project from the respective bases and which mutually engage;

a motor providing a rotational output on a drive shaft, the drive shaft operatively driving one of the scroll compressor bodies to facilitate relative movement for the compression of fluid;

a motor housing in surrounding relation of the motor;

a flow path for fluid running through outer housing from the inlet port to the outlet port, a portion of the flow path running through the motor housing;

at least one motor outlet adapted to communicate fluid inside the motor housing to outside of the motor housing;

a bearing member having a central hub rotatable supporting the drive shaft and body portion extend radially outward therefrom; and wherein the motor housing includes cylindrical body having a continuous circular terminating edge, the terminating edge abutting the bearing member, wherein a relief formed into the bearing member provides for the at least one motor outlet between the motor housing and the bearing member; and wherein the at least one motor housing outlet comprises a plurality of motor housing outlets, further comprising:

a plurality of through ports along the flow path communicating fluid from one axial side of the bearing member toward the other axial side, wherein the through ports are defined between the bearing member and the outer housing, and wherein the each motor outlet is arranged at a different angular position about the central axis than each through port.

10. The scroll compressor of claim 9, wherein the motor housing is spaced from the outer housing and not in contact therewith.

11. The scroll compressor of claim 9, wherein the plurality of through ports include two through ports arranged 180 degrees apart relative to the central axis, wherein the motor outlets are on opposite sides of the motor housing in regions between the through ports.

12. The scroll compressor of claim 11, further comprising deflector walls integrally provided by the bearing member interrupting flow from the motor housing outlets to the through ports.

13. The scroll compressor of claim 12, wherein the deflector walls are substantially cylindrical wall sections that project axially from the bearing member in a direction away from the compressor bodies.

14. A scroll compressor for compressing fluid, comprising, an outer housing having an inlet port and an outlet port;

scroll compressor bodies in the outer housing, the scroll compressor bodies having respective bases and respective scroll ribs that project from the respective bases and which mutually engage;

a motor providing a rotational output on a drive shaft, the drive shaft operatively driving to one of the scroll compressor bodies to facilitate relative movement for the compression of fluid;

a motor housing in surrounding relation of the motor;

a flow path for fluid running through the outer housing from the inlet port to the outlet port, a portion of the flow path running through the motor housing;

at least one motor outlet adapted to communicate fluid inside the motor housing to outside of the motor housing;

a bearing member rotatably supporting the drive shaft; and wherein the bearing member is configured to interrupt the fluid flow in a region of the motor outlet; and wherein the bearing member is further configured to redirect fluid axially in a direction away from the scroll compressor bodies; and wherein the fluid flow is interrupted by a portion of the bearing member located outside of the motor housing and in alignment with the motor outlet.

15. The scroll compressor of claim 14, further comprising:

at least one through port along the flow path communicating fluid from one axial side of the bearing member toward the other axial side; and wherein the each motor outlet is arranged at a different angular position about the central axis than each through port.

16. The scroll compressor of claim 14, wherein the motor housing includes a substantially cylindrical body having a continuous circular terminating edge, the terminating edge abutting the bearing member, wherein a relief formed into the bearing member provides for the at least one motor outlet between the motor housing and the bearing member.

17. A scroll compressor for compressing fluid, comprising, an outer housing having an inlet port and an outlet port;

scroll compressor bodies in the outer housing, the scroll compressor bodies having respective bases and respective scroll ribs that project from the respective bases and which mutually engage;

a motor providing a rotational output on a drive shaft, the drive shaft operatively driving to one of the scroll compressor bodies to facilitate relative movement for the compression of fluid;

a motor housing in surrounding relation of the motor;

a flow path for fluid running through the outer housing from the inlet port to the outlet port, a portion of the flow path running through the motor housing;

at least one motor outlet adapted to communicate fluid inside the motor housing to outside of the motor housing;

a bearing member rotatably supporting the drive shaft; and at least one through port along the flow path communicating fluid from one axial side of the bearing member toward the other axial side; and wherein the each motor outlet is arranged at a different angular position about the central axis than each through port.

18. The scroll compressor of claim 17, wherein the at least one motor outlet is defined jointly by the motor housing and the bearing member.

19. The scroll compressor of claim 18, wherein the motor housing includes a substantially cylindrical body having a continuous circular terminating edge, the terminating edge abutting the bearing member, wherein a relief formed into the bearing member provides for the at least one motor outlet between the motor housing and the bearing member.

20. The scroll compressor of claim 18, wherein the motor housing includes a substantially cylindrical body spaced from the outer housing with an annular chamber defined therebetween, a portion of the annular chamber disposed between the at least one motor outlet and the at least one through port.

21. The scroll compressor of claim 17, wherein two through ports are provided and spaced 180 degrees apart relative to the central axis, and wherein the motor outlets are on opposite sides of the motor housing in regions between the through ports.

22. The scroll compressor of claim 17, wherein the through ports are defined between the bearing member and the outer housing.

* * * * *